United States Patent [19]

Boutros et al.

[11] 4,432,592

[45] Feb. 21, 1984

[54] ELECTRICAL CONNECTOR ASSEMBLY

[75] Inventors: Kamal S. Boutros, Downsview; John W. Fenn, Agincourt, both of Canada

[73] Assignee: Allied Corporation, Morris Township, Morris County, N.J.

[21] Appl. No.: 12,986

[22] Filed: Feb. 21, 1979

[51] Int. Cl.[3] ..... H01B 7/06

[52] U.S. Cl. ..... 339/103 M

[58] Field of Search ..... 174/138 F, 147; 339/103 R, 103 B, 103 M, 107, 223, 272 UC, 92 M, 95 R, 95 D, 96, 97 R, 100

[56] References Cited

U.S. PATENT DOCUMENTS 3,055,971 9/1962 Lander ..... 339/103 M X
3,286,963 11/1966 Bergman ..... 174/147
3,599,172 8/1971 Tuchto et al. ..... 339/98
4,127,315 11/1978 McKee ..... 339/103 B
4,127,316 11/1978 McKee et al. ..... 339/103 R
4,130,329 12/1978 Chandler et al. ..... 339/75 M
4,130,330 12/1978 Chandler ..... 339/75 M

*Primary Examiner*—Howard N. Goldberg
*Assistant Examiner*—Timothy V. Eley
*Attorney, Agent, or Firm*—Roger H. Criss

[57] ABSTRACT

An electrical connector is disclosed having a protective hood and strain relief means. The strain relief means includes a pair of opposing clamping members that are displaced from an initial cable receiving position to a final cable clamping position. The displacement of the clamping members is effected automatically and simultaneously with the assembly of the hood to the connector without requiring any tools.

15 Claims, 8 Drawing Figures

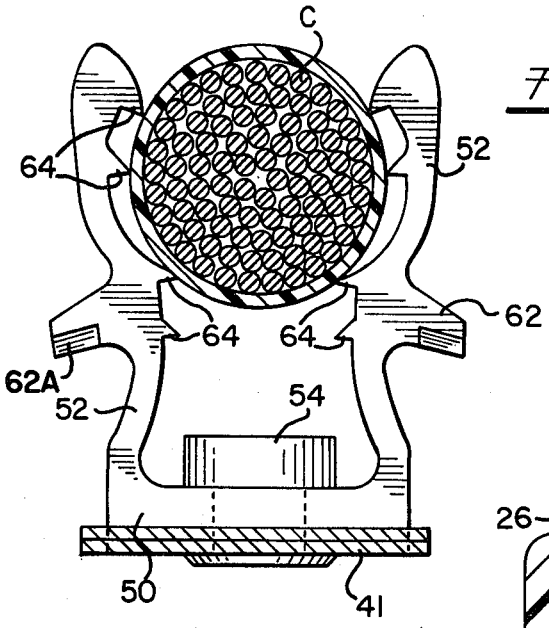
FIG. 4
FIG. 5
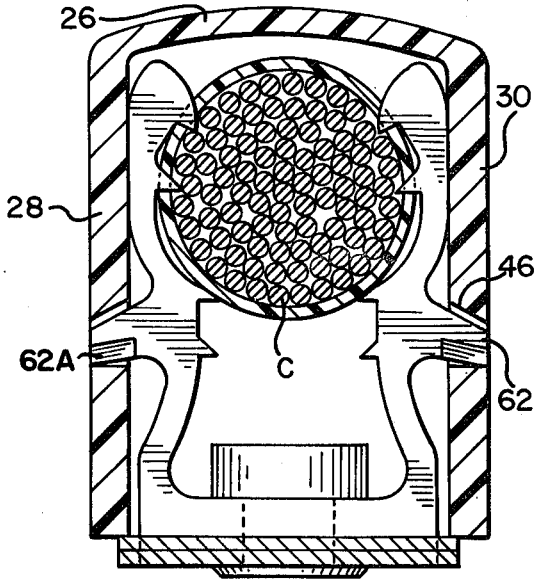
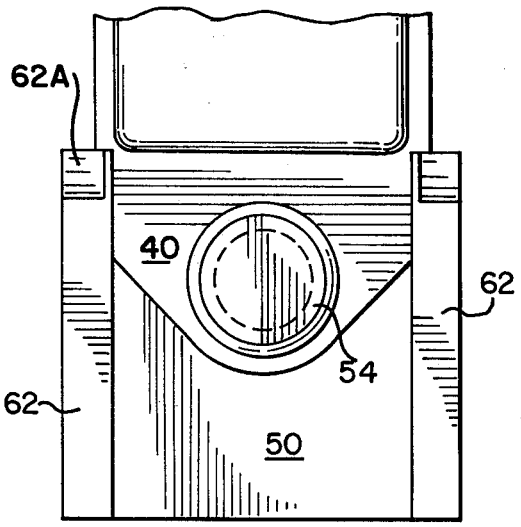
FIG. 6

ELECTRICAL CONNECTOR ASSEMBLY

BACKGROUND OF THE INVENTION

The present invention is directed generally to electrical connectors and, more particularly, to an improved electrical connector assembly including a hood used to house or enclose the terminating section of the connector and a strain relief mechanism.

In recent years, a variety of multi-contact electrical connectors have been developed for use in the data processing and communications industries. A substantial demand for such connectors has arisen in the telephony market where multiconductor, jacketed cable is used extensively in and between switching equipment, PBX's and computers. These connectors conventionally include an array or either solder or solderless terminals, each of which electrically connects or terminates an individual insulated conductor. In order to protect the connections formed between the bare ends of the conductors and the respectively associated terminals of the connector, a hood is conventionally employed and secured to the body of the connector to enclose or house the individual terminations.

For many years, conventional ribbon connectors have included a metal housing as a part of the connector body and metal protective hoods and cable clamping devices. Recently, however, a demand has arisen for ribbon connectors having most if not all of its exterior surfaces fabricated from an insulating material such as plastic. Such connectors are preferred since they reduce the possibility of inadvertently shorting non-insulated circuitry in close proximity to the connector in the telephone switching equipment and other concentrated circuit aparatus used in the telephone industry. Accordingly, a number of so called "all-plastic" connectors have been developed wherein the connector body and hood are fabricated from plastic and the metallic and electrically conductive components of the connector are completely or substantially housed within the plastic components. Typical examples of such prior art connectors wherein either the connector body or hood, or both, are fabricated of plastic are illustrated in U.S. Pat. Nos. 3,657,682; 3,803,530; 3,936,129; 4,035,051; 4,070,548; 4,089,579; and 4,090,770.

It has also long been recognized that some type of strain relief mechanism is desirable, or even necessary, to mechanically secure the conductor or cable terminated in connector. Otherwise, strain imposed on the terminated cable due to applied tension or other severe movement might impair the electrical connection or entirely separate one or more of the conductors from the electrical contacts within the connector. Therefore, a wide variety of strain relief mechanisms have been devised for use in conjunction with electrical connectors. Typical examples of such prior art connectors include those disclosed in U.S. Pat. Nos. 3,657,682; 3,629,803; 3,055,971; and 3,794,960.

While all of these prior art connectors have certain advantages and some have enjoyed commercial success, they nevertheless suffer from certain disadvantages that limit their utility. For example, none of these connector assemblies provides a hood and strain relief both of which are utilized without the need of any tools. In addition, the prior art fails to provide a connector assembly in which the strain relief is clamped to the cable simultaneously with positioning of the hood in a one step assembly procedure. Finally, the prior art connectors often include multi-component structures which increase the costs of manufacture and assembly and tend to shorten the useful service life of the connectors.

SUMMARY OF THE INVENTION

The present invention is directed to an electrical connector assembly that overcomes or minimizes the problems and disadvantages associated with prior art connectors. The connector assembly includes both a protective shroud or hood and a strain relief mechanism, each of which is simply designed permitting manufacture by low cost injection molding techniques. Both the protective hood and the strain relief mechanism are adapted for use without the need for any tools and allow the hood to be assembled to the connector while at the same time fully securing the associated electrical cable within the strain relief mechanism.

Accordingly, one aspect of the present invention is to provide an electrical connector having improved means for strain relief.

Another aspect of the present invention is to provide a strain relief mechanism for an electrical connector that is easily secured to or disengaged from the cable terminated in the connector without requiring the use of any tools.

A still further aspect of the invention is the provision of a strain relief mechanism for an electrical connector which accepts cables of different sizes.

Another aspect of the invention is the provision of an all plastic, injection molded hood and strain relief mechanism used in conjunction with ribbon connectors which cooperate with one another to completely protect and secure the terminations made between the individual conductors and the contacts of the connector.

In accordance with the present invention, the electrical connector assembly of the present invention generally includes a connector body, a protective hood and strain relief means. The connector body houses or supports a plurality of electrical contacts which extend from a terminal section of the connector body to a mating section of the body which is suitably configured for engagement to a complimentary connector. The protective hood is of a size and configuration to enclose the terminal section of the connector body, and in its finally assembled position also houses the strain relief means. The strain relief means is fixedly mounted to the connector body and includes a pair of resilient clamping members adapted to receive the cable being interconnected to the connector. The clamping members in their free, unstressed state assume an initial position which accomodates placement of the cable in between, but are automatically displaced inwardly to a final cable-clamping position as the protective hood is mounted in its finally assembled position on the connector body.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

FIG. 4 is an enlarged end view illustrating a multi-conductor cable disposed within the strain relief mechanism of the present invention while in its initial cable-receiving position;

FIG. 5 is an enlarged cross-sectional view similar to FIG. 2 showing the strain relief mechanism in its final cable-clamping position;

FIG. 6 is an enlarged partial elevational view taken along lines 6—6 of FIG. 2 and showing further details of the connector assembly;

DETAILED DESCRIPTION OF THE INVENTION

Figure 1:
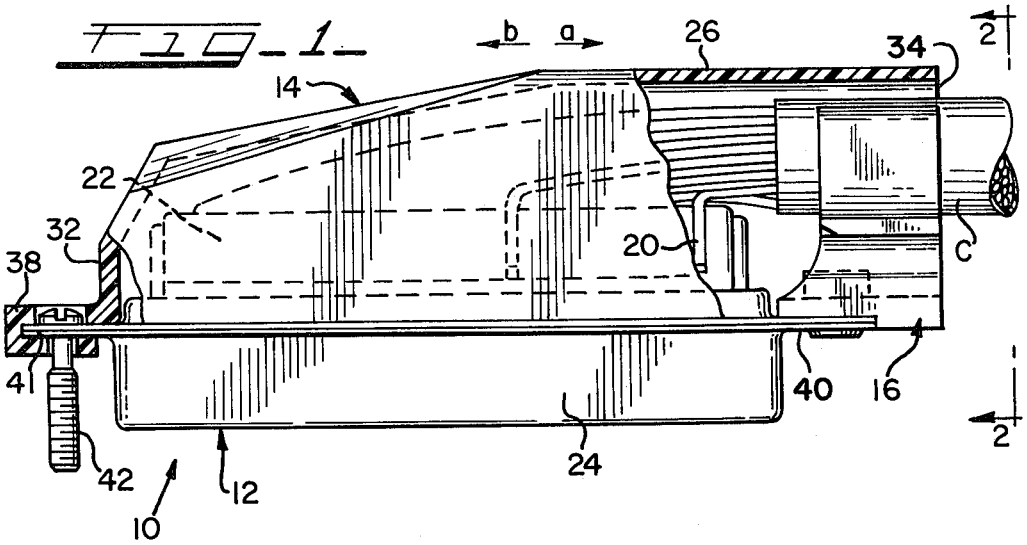
FIG. 1 is a side elevational view of the electrical connector assembly of the present invention with portions broken away to illustrate certain details of the assembly.

Although those skilled in the art will readily comprehend the applicability of the present invention to a wide variety of electrical connectors, the invention finds particular utility and advantage when applied to high density ribbon connectors. Accordingly, the invention has been illustrated in the drawings and will be hereinafter described with reference to such connectors, the design and construction of which are well known in the art.

Referring now to the drawings and particularly FIG. 1, an electrical connector assembly constructed in accordance with the present invention is shown and designated generally as 10. The connector assembly 10 includes a connector body 12, a protective hood 14 and strain relief means 16, and is illustrated in finally assembled relation in interconnection with a conventional multi-conductor cable C.

The connector body 12 houses or supports a plurality of electrical contacts 20 that extend from the terminal section 22 to the mating section 24 of the connector body. The contacts may be of any well known construction, and each will electrically and mechanically engage and individual conductor in the terminal section of the connector body.

Figure 2:
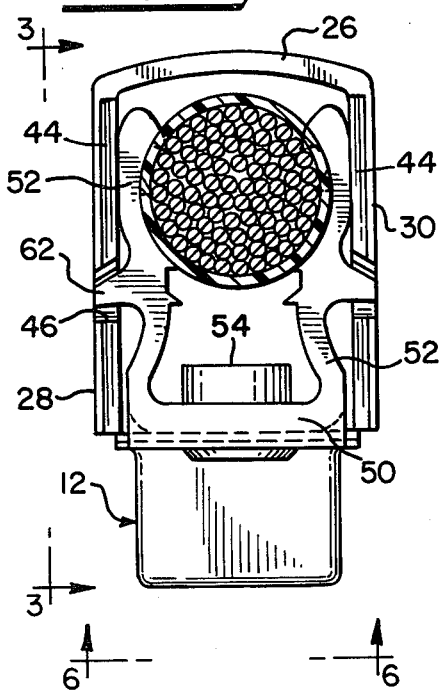
FIG. 2 is an end view of the connector assembly taken along line 2—2 of FIG. 1.

The protective hood 14 includes a top wall 26, side walls 28 and 30, and end wall 32 which together form an enclosure having a sufficient size and appropriate configuration to enclose the entirety of terminal section 22 of the connector body 12. The hood 14 also has an open end 34 opposite to end wall 32. Adjacent end wall 32, the hood 14 also includes a housing member 38 adapted to receive the flange 40 found on many conventional ribbon connectors. Both the housing member 38 and flange 40 have aligning apertures to permit the placement of a bolt 42 or other fastening device conventionally used to secure the connector assembly 10 to a complimentary connector or electrical component. Finally, the hood 14 also includes inwardly facing camming surfaces 44 on the free ends of walls 28 and 30 (see FIG. 2) and a pair of longitudinally extending slots 46 in each of the side walls. The purpose and function of the camming surfaces 44 and slots 46 will be described below.

Figure 3:
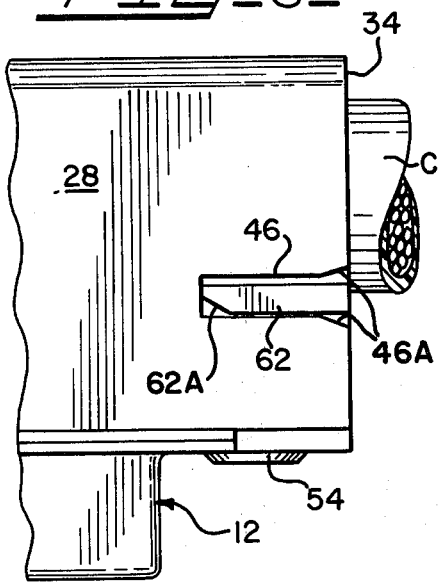
FIG. 3 is an enlarged partial side elevation taken along line 3—3 of FIG. 2 and illustrating the cooperation of certain components of the connector assembly.

The strain relief means 16 comprises a generally U-shaped element having a base 50 for mounting to the connector body 12 and a pair of upstanding legs 52. The base 50 has a recess shaped to receive the flange 41 of the connector body, and an aperture in the base aligns with an aperture in flange 41 to permit fixed assembly of the strain relief means to the connector body by rivet 54 or other conventional fastening devices. The legs 52 are resilient and together comprise an opposing pair of clamping members. In their free state, or initial position, as shown in FIG. 4, the legs 52 are spaced sufficiently to permit the insertion of the cable C therebetween. These legs are moved or displaced inwardly as the hood 14 is assembled to the connector body, the legs 52 ultimately engaging the cable in the final, cable clamping position illustrated in FIG. 5. Of course, with the hood 14 in the assembled position shown for example in FIGS. 1, 3 and 5, the sidewalls 28 and 30 engage and urge the legs 52 into the cable C and maintain the strain relief mechanism in the cable-clamping position.

Figure 8:
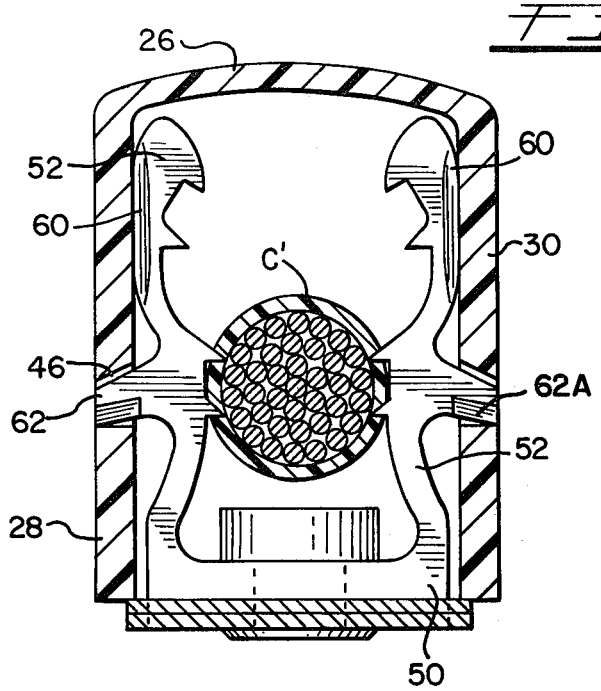
FIG. 8 is a cross-sectional view taken along line 8—8 of FIG. 7.
Figure 7:
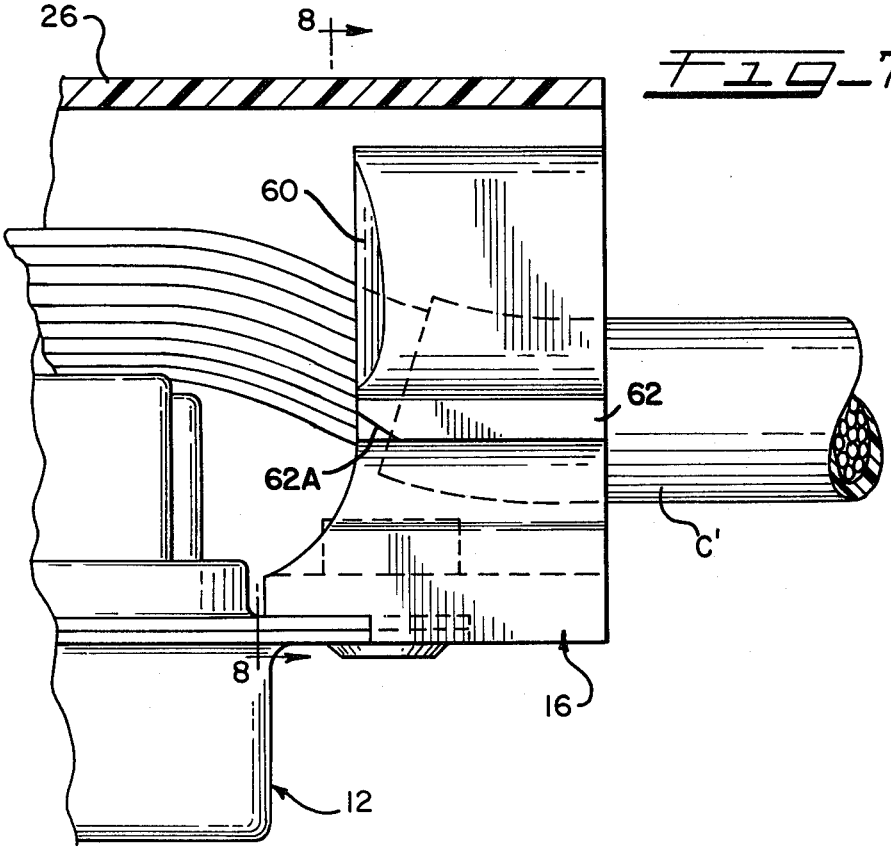
FIG. 7 is an enlarged and partial cross-sectional view illustrating the connector assembly of the present invention interconnected to a smaller diameter cable.

The strain relief means 16 also includes outwardly facing camming surfaces 60 (best seen in FIGS. 7 and 8) and longitudinally projecting ribs 62. The camming surfaces 60 of the strain relief means bear against the camming surfaces 44 of the hood 14 as the hood is slid longitudinally along the connector body towards its finally assembled position. These engaging camming surfaces facilitate the clamping action and urge the legs 52 inwardly as the hood moves longitudinally. The ribs 62 engage the slots 46 and prevent vertical movement of the hood 14 relative to the connector body and strain relief means. The strain relief means 16 also includes inwardly extending protuburances 64 which serve to mechanically engage the cable to improve cable retention capability.

Finally, it will be noted that the legs 52 are shaped to provide a greater spacing at the upper portion of the strain relief means and a lesser spacing at its lower portion. This design permits the use of a single part as a suitable strain relief structure for at least two differently sized cables. Thus, FIGS. 1 through 5 illustrate the use of the invention with a relatively large diameter cable C, whereas FIGS. 7–8 demonstrate the use of the same structure with a cable C′ having a relatively small diameter.

In the operation and use of the present invention, the individual conductors are first terminated to the contacts supported within the connector body 12, and the multi-conductor cable C is disposed within the free-standing legs 52 of the strain relief means 16 as shown in FIG. 4. Next the hood 14 is positioned adjacent the terminal section of the connector body 12 and moved longitudinally along the connector body (FIG. 1, arrow a) to its finally assembled position shown, for example, in FIG. 1. As the hood is assembled to the connector body the free ends 34 and then the inside surfaces of the walls 28 and 30 engage legs 52 and displace them inwardly and transversely to the axis of cable C to the clamping position shown in FIG. 5. To disassemble the hood from the connector body and release the strain relief means, the hood is merely slid in the opposite direction (FIG. 1, arrow b) until it clears the legs 52 of the strain relief. It will be appreciated that this procedure is not only extremely simple but it does not require the use of any tools, as well. Alternatively, the hood may be assembled to the connector body from above with the side walls 28 and 30 again displacing the clamping legs inwardly to the clamping position. Thus, the hood is assembled to its final position and simultaneously displaces the clamping members by movement either longitudinal or transverse to the axis of the cable disposed within the strain relief means.

Of course, it should be understood that various changes and modifications to the preferred embodiments described herein will be apparent to those skilled in the art. Such changes and modifications can be made without departing from the spirit and scope of the present invention and without diminishing its attendant advantages. It is therefore, intended that such changes and modifications be covered by the following claims.

I claim:

1. An electrical connector assembly comprising:

a connector body having a mating section and a terminal section;

a hood including opposing sidewalls for enclosing the terminal section of said connector body; and strain relief means on said connector body including opposing clamping members adapted to receive a cable therebetween, said clamping members being resilient and movable in a direction transverse to the axis of the cable placed therebetween from an initial cable-receiving position to a final cable-clamping position, said transverse movement of said clamping members being effected by mounting said hood to its finally assembled position whereby said hood sidewalls urge said clamping members into said final cable-clamping position.

2. The electrical connector assembly of claim 1 wherein said strain relief means comprises a dielectric plastic U-shaped element having resilient leg portions forming said clamping members, said hood also enclosing said U-shaped element when assembled to said connector body.

3. The electrical connector assembly of claim 2 further including camming members to facilitate the transverse movement of said clamping members and assembly of said hood onto said connector body.

4. An electrical connector assembly for interconnection with a multi-conductor cable comprising:

a connector body having a mating section to receive a complimentary electrical connector and a terminal section to receive electrical conductors for termination to the connector body;

a plurality of electrical contacts mounted within said body, each including means for terminating an individual electrical conductor;

a hood for enclosing the terminal section of said connector body; and strain relief means fixedly mounted on said body and including a pair of clamping members adapted to receive the multiconductor cable therebetween, said clamping members being resilient and movable in a direction transverse to the axis of the cable from an initial cable-receiving position to a final cable-clamping position, said hood being engageable with said clamping members whereby said transverse movement of said clamping members to said final cable-clamping position is effected by mounting said hood to its finally assembled position on said connector body.

5. The electrical connector assembly of claim 4 wherein said strain relief means includes means to accommodate cable of different diameters.

6. The electrical connector assembly of claim 4 wherein said strain relief means is constructed from a dielectric plastic material.

7. The electrical connector assembly of claim 4 wherein said hood is constructed from a dielectric plastic material.

8. The electrical connector assembly of claim 4 wherein said hood and said strain relief means are constructed from a dielectric plastic material.

9. The electrical connector assembly of claim 4 wherein said strain relief means comprises a generally U-shaped injection molded plastic element including a base and upstanding legs comprising said clamping members.

10. The electrical connector assembly of claim 4 wherein said clamping members each includes inwardly extending protuberances adapted to frictionally engage said cable.

11. The electrical connector assembly of claim 4 wherein said hood and said strain relief means include cooperative means for preventing vertical movement of said hood relative to said strain relief means.

12. The electrical connector assembly of claim 4 wherein said hood includes a top wall and two depending side walls, said hood having a size sufficient to receive said strain relief means within said top and side walls with said side walls urging said clamping members into said final cable-clamping position; and said side walls and said clamping members having cooperating cam surfaces to facilitate movement of said clamping members from said initial position to said final position.

13. An electrical connector assembly for interconnection with a multi-conductor cable comprising:

a connector body having a mating section to receive a complimentary electrical connector and a terminal section to receive electrical conductors for termination to the connector body;

a plurality of electrical contacts mounted within said body, each including means for terminating an individual electrical conductor;

a hood for enclosing the terminal section of said connector body;

strain relief means fixedly mounted on said body and including a pair of clamping members adapted to receive the multi-conductor cable therebetween, said clamping members being resilient and movable in a direction transverse to the axis of the cable from an initial cable-receiving position to a final cable-clamping position; and means on said hood engageable with said clamping members for moving said clamping members from said initial position to said final cable-clamping position in response to movement of said hood relative to said connector body to its finally assembled position on said connector body.

14. The electrical connector assembly of claim 13, wherein said hood is assembled to said connector body and simultaneously moves said clamping members to said final position by a movement in a direction longitudinal to the axis of the cable disposed within said strain relief means.

15. The electrical connector assembly of claim 13 wherein said hood is assembled to said connector body and simultaneously moves said clamping members to said final position by a movement in a direction transverse to the axis of the cable disposed within said strain relief means.

* * * * *